US005522760A

United States Patent [19]

Patel et al.

[11] Patent Number: 5,522,760

[45] Date of Patent: Jun. 4, 1996

[54] METHOD OF MICRODEBURRING A BORE

[75] Inventors: Deepak Patel; Martin W. Long, both of Columbus, Ind.

[73] Assignee: Cummins Engine Company, Inc., Columbus, Ind.

[21] Appl. No.: 293,807

[22] Filed: Aug. 22, 1994

[51] Int. Cl.[6] ..... B24C 3/00

[52] U.S. Cl. ..... 451/75; 451/102

[58] Field of Search ..... 451/104, 36, 38, 451/39, 40, 75, 76, 54, 103, 102

[56] References Cited

U.S. PATENT DOCUMENTS

| | | | |
|---|---|---|---|
| 3,193,975 | 5/1961 | Millhiser . | |
| 3,485,074 | 12/1969 | Compton . | |
| 3,535,758 | 10/1970 | Hoet . | |
| 3,629,093 | 12/1971 | Sickels . | |
| 3,729,871 | 5/1973 | Taylor . | |
| 3,763,603 | 10/1973 | Trischuk . | |
| 3,795,175 | 3/1974 | Numao et al. . | |
| 4,473,735 | 9/1984 | Steffen . | |
| 4,578,164 | 3/1986 | Matsui et al. . | |
| 4,716,684 | 1/1988 | Roach | 451/36 |
| 4,771,659 | 9/1988 | Schmolke . | |
| 4,848,122 | 7/1989 | Sullivan | 451/39 |
| 4,882,879 | 11/1989 | Warner et al. . | |
| 4,893,642 | 1/1990 | Parslow, Jr. et al. . | |
| 4,899,712 | 2/1990 | De Bruyn et al. . | |
| 4,995,949 | 2/1991 | Rhoades . | |
| 5,054,247 | 10/1991 | Rhoades et al. . | |
| 5,107,631 | 4/1992 | Wern | 451/102 |
| 5,112,131 | 5/1992 | Pryor . | |
| 5,161,336 | 11/1992 | Ritt et al. | 451/87 |
| 5,185,957 | 2/1993 | Mizuguchi et al. | 451/36 |
| 5,218,788 | 6/1993 | Ritt et al. . | |
| 5,218,791 | 6/1993 | Parent et al. . | |
| 5,277,528 | 1/1994 | Robinson . | |

FOREIGN PATENT DOCUMENTS

| | | | |
|---|---|---|---|
| 0554163 | 8/1993 | European Pat. Off. | 451/38 |
| 0297356 | 1/1992 | German Dem. Rep. | 451/36 |
| 402048154 | 2/1990 | Japan | 451/36 |

*Primary Examiner*—Bruce M. Kisliuk
*Assistant Examiner*—Derris Banks
*Attorney, Agent, or Firm*—Sixbey Friedman Leedom & Ferguson

[57] ABSTRACT

A method of microdeburring a selected portion of bore in a workpiece with a jet of abrasive gas is provided that is particularly applicable to the removal of microburrs at the interface between the timing and metering spill ports in a fuel injector metering barrel and the plunger bore. In the method, the nozzle that emits the abrasive gas is first inserted in and aligned with the bore so that the jet is focused on the microburrs at the interface. The nozzle is then actuated for a time period long enough for the jet to remove the microburrs from the bore, but insufficient for the jet to cause unwanted radiusing of the bore at the interface that could degrade the timing characteristics of the fuel injector. The method also includes the step of interposing a shield within the metering barrel to mask off the finished surface of the barrel from unwanted abrasion. The use of a gaseous, as opposed to a liquid carrier, in combination with the precise alignment of the jet and use of an abrasion shield in the workpiece, results in a precise elimination of unwanted microburrs that is unaccompanied by unwanted widening or radiusing of the ports at their interface with the plunger bore.

17 Claims, 5 Drawing Sheets

METHOD OF MICRODEBURRING A BORE

BACKGROUND OF THE INVENTION

This invention generally relates to a method for microdeburring small bores, and is particularly concerned with the removal of microburrs from the timing and metering spill ports in the fuel metering barrel of a diesel engine fuel injector.

Methods for deburring the microbores that form the timing and metering spill ports in metering barrels are known in the prior art. However, before the shortcomings associated with such prior art deburring methods can be appreciated, some background with respect to the manufacturing and operation of such metering barrels is necessary.

Metering barrels form part of the fuel injectors of diesel internal combustion engines. The function of such barrels is to precisely meter a timed flow of diesel fuel through the fuel injectors, which in turn inject the fuel into the individual cylinders of the engine. To this end, such metering barrels include an elongated cylindrical body having an axially oriented bore (known as the plunger bore) through which a metering plunger reciprocates. The cylindrical wall of the metering barrel is radially traversed by both a timing spill port and a metering spill port which are spaced apart along the longitudinal axis of the barrel. Both the timing and metering spill ports are formed from small, laser-drilled holes only about 24/1000 of an inch in diameter that intersect with the plunger bore that forms the inner diameter of the barrel. In operation, the metering barrel precisely meters and regulates a timed flow of diesel fuel to the cylinders of the diesel engine by means of a spool-valve type interaction between the head of the metering plunger that reciprocates through the barrel, and the small-diametered timing and metering spill ports that interface with the plunger bore.

In order for the metering barrel to effectively perform its function within the fuel injector, the diameter of the metering and timing spill ports at the point of interface with the plunger bore must not deviate significantly from the port diameter 24/1000. Unfortunately, during the manufacturing of the metering barrel, microburrs are formed around the inner diameter of the metering and timing spill ports at the interface of the plunger bore both as the result of the laser boring operations and the honing operations which are necessary to create a micro-finished surface within the barrel through which the plunger can reciprocate in a fluid-tight relationship. Because these microburrs have the effect of reducing the diameter of the metering and timing spill ports at their critical interface with the plunger bore, they must be removed.

In the past, these microburrs were removed by conducting a pressurized flow of abrasive liquid through the timing and metering ports. The liquid used might be formed, for example, from glass microbeads entrained in a silicone polymer-based liquid that is pressurized to 5000 psi and expelled from a nozzle. While such a pressurized, abrasive liquid has proven to be effective in removing the microburrs from such ports, the applicants have observed a number of shortcomings associated with this technique. Specifically, the applicants have observed that the use of such a pressurized abrasive liquid creates an unwanted widening or radiusing of the timing and metering ports in the area where they intersect the plunger bore, thus effectively increasing their diameter to a size substantially larger than the 24/1000 diameter necessary for them to accurately perform their task. Such widened or "radiused" bores causes the metering spill port to start conducting a flow of fuel earlier and to end this flow later than normal, thereby causing the fuel injector to inject excess fuel in its respective diesel cylinder. The excess fuel condition is not only wasteful of fuel, but increases the amount of diesel pollutants expelled out of the exhaust system of the engine. Additionally, the silicone polymer-based liquid carrier of the abrasive particles is difficult to completely remove from the metering barrel after the deburring operation has been completed. The unremoved particles of abrasive and removed metal can lodge between the inner surface of the barrel and the plunger, resulting in serious scarring of the barrel surface (which compromises the seal it makes with the reciprocating plunger), and sometimes even causing injector sticking. While a tubular shield may be interposed around the inner diameter of the injector barrel during the deburring process in order to prevent the abrasive liquid from scarring the polished inner surface of the barrel, the high abrasiveness of the liquid abrasive mandates the use of heavy, thick walled shields that wear out quickly, and must be replaced frequently. The hydraulic equipment necessary to create and maintain the high pressure of the liquid abrasive is expensive, as is the silicone polymer-based carrier that forms most of the volume of the abrasive liquid. Finally, this equipment is difficult to start and stop within the small time period (i.e., a fraction of a second) that it takes for the resulting pressurized stream to microdeburr the bore, which is a factor which contributes to unwanted radiusing.

Clearly, what is needed is a method for microdeburring bores in a workpiece which is capable of completely and effectively removing such burrs without widening or radiusing the bores, particularly in the area where the bores interface a finished surface. Ideally, such a method should leave behind a minimum of abrasive residue, which in turn can be completely, easily and precisely removed from the workpiece. Finally, such a method should be easily and precisely controllable so that excess abrasive action can be avoided, and implementable by relatively inexpensive equipment.

SUMMARY OF THE INVENTION

Generally speaking, the invention is a method of microdeburring the interface between a bore and a surface in a workpiece, such as the metering barrel of an injector, that overcomes the aforementioned shortcomings associated with the prior art. In the method of the invention, a nozzle for selectively directing and focusing an abrasive is first aligned and positioned with respect to the bore so that the focal plane of the jet is adjacent to the interface to be deburred. The nozzle is then actuated for a time period sufficient for the abrasive jet of gas to remove burrs from the interface, but insufficient for the jet to cause unwanted widening of the bore at the interface. The nozzle is then deactuated and removed from the bore. Because the rapid starting and stopping of a relatively low pressure flow of gas is easier to control than a flow of liquid at a higher pressure, and because the use of an abrasive gas results in a somewhat slower deburring time, control of the deburring action is vastly increased over the prior art. To further increase control of the deburring operation, the diameter of the nozzle opening is selected to be about the same diameter or slightly smaller than the diameter of the bore being microdeburred to avoid the creation of turbulence in the jet.

The method is particularly applicable to the removal of burrs present at the interface between the timing and metering spill ports of a fuel injector metering barrel, and the plunger bore that forms the inner diameter of the barrel. In such metering barrels, the nozzle is inserted into and aligned with either the timing spill port or the metering spill port such that the focal plane of the abrasive gaseous jet emitted contacts the microburrs at the interface between the port and the plunger bore that have been caused by laser drilling or the honing operations or the like. In the preferred embodiment of the method, the abrasive jet is formed from abrasive particles of aluminum oxide having an average size of between about 10 and 50 microns that are entrained in a jet of air pressurized between about 100 and 150 psi. After appropriate alignment, the nozzle is actuated for a time period of preferably between about two and five seconds. The resulting abrasive jet cleanly removes any microburrs at the interface between either the timing spill or metering spill ports and the plunger bore without enlarging or radiusing the spill ports where they intersect with the plunger bore, thereby maintaining a crisp and sharp valve action between the plunger and these ports during the operation of the metering barrel.

To protect the honed and polished surface of the plunger bore that forms the inner diameter of the metering barrel, a tubular shield is disposed within the plunger bore during the actuation of the abrasive jet emitting nozzle. The tubular shield includes openings which are registrable with the outlet ends of the spill bores that radially extend through the barrel walls, but otherwise completely covers the finely honed interior of the plunger bore to protect it from unwanted abrasion.

After the nozzle has been deactuated and removed, any residual abrasive particles may be easily removed by a spray of compressed air and an ultrasonic cleaning.

The gaseous abrasive jet employed in the method of the invention is far easier to finely control than the liquid abrasive jets used in the prior art, and is capable of removing microburrs in very small holes or bores in a workpiece without unwanted radiusing between these bores and the walls that they interface with. The equipment necessary to generate an abrasive gaseous jet is much simpler and less expensive than the equipment necessary for the generation of a liquid abrasive jet. The protective shields used to insulate the rest of the workpiece from the abrasive jet can be made from thinner materials and last much longer than the type of shield necessary for use in a liquid abrasive jet operation. Finally, the lack of a liquid carrier makes it much easier to completely clean and remove residual abrasive particles from the workpiece.

BRIEF DESCRIPTION OF THE SEVERAL FIGURES

Figure 3:
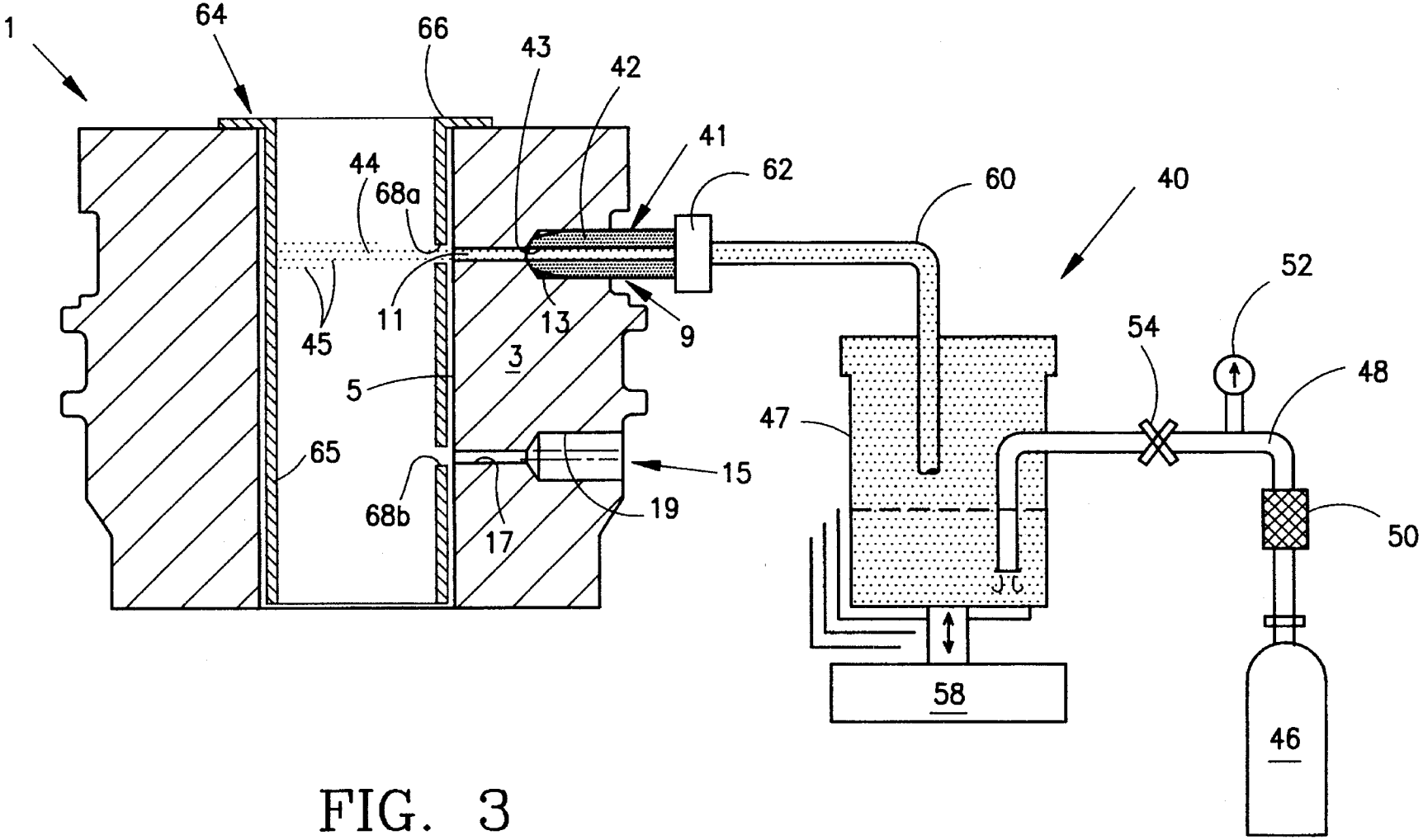
FIG. 3 is a schematic view of an abrasive gas generating system for implementing the microdeburring method of the invention.
Figure 4A:
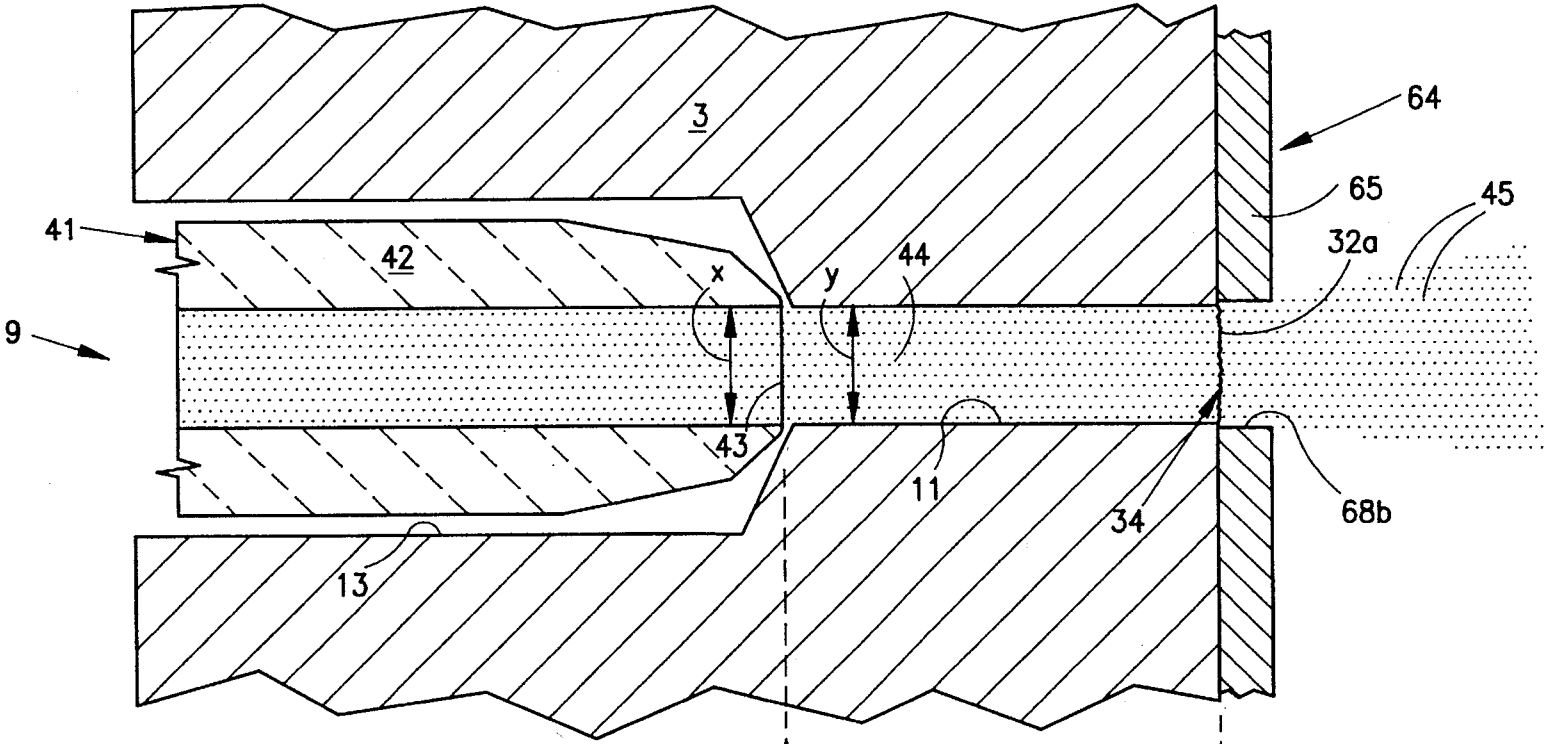
Figure 4B:
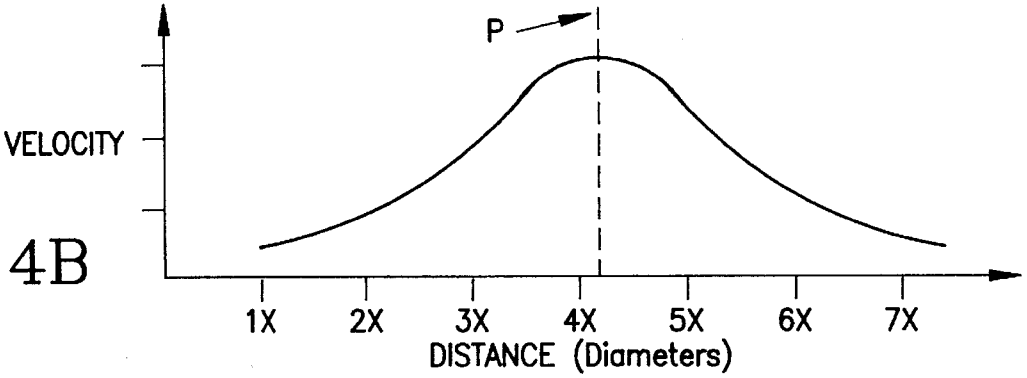

FIG. 4A is an enlargement of the area circled in FIG. 3, illustrating the relationship between the diameter of the nozzle orifice of the gas generating system, the diameter of the flow control portion of the timing and metering spill ports, and the distance between the end of the nozzle tip and the interface between these ports and the plunger bore that forms the inner diameter of the metering barrel, and FIG. 4B is a graph illustrating the relative velocity of the abrasive particles in the gas jet generated by the system illustrated in FIG. 3 as a function of distance, wherein the distance units are multiples of the diameter of the nozzle orifice.

DETAILED DESCRIPTION OF THE PREFERRED EMBODIMENT

Figure 1A:
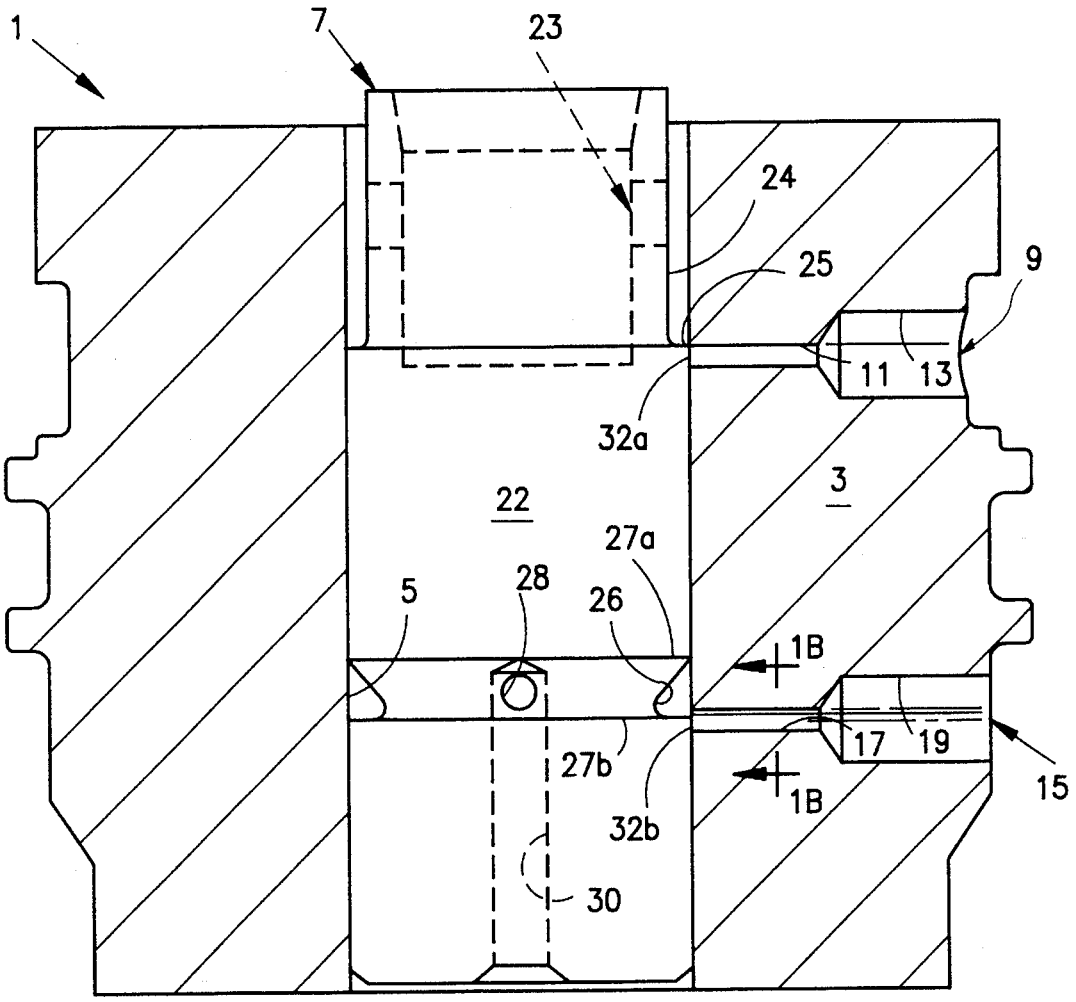
FIG. 1A is a cross-section side view of a metering barrel of a diesel fuel injector, illustrating the valving action between the metering plunger and the timing and metering spill ports.
Figure 1B:
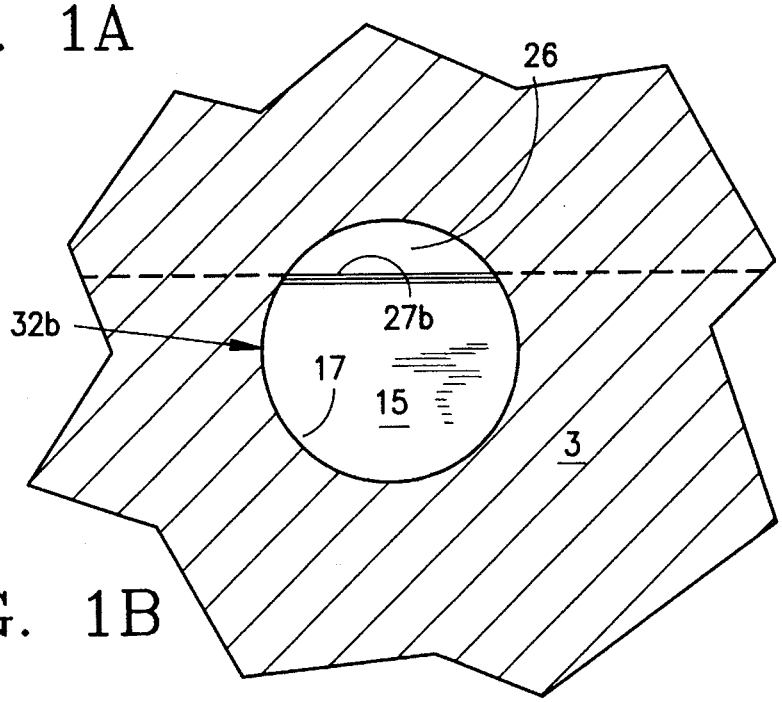
FIG. 1B is an enlargement of the flow control portion of the metering spill port along the line 1B—1B in FIG. 1A, illustrating in particular how this port interacts in spool-valve fashion with an edge of the metering plunger.

With reference to FIG. 1A and 1B, wherein like numerals designate like components throughout all the several figures, the method is particularly applicable to microdeburring the timing and metering spill ports of a metering barrel 1 of a diesel fuel injector. Such metering barrels 1 generally comprise an annular barrel wall 3 having a plunger bore 5 concentrically disposed along its axis of rotation for slidably receiving a cylindrical metering plunger 7. Radially disposed through the wall 3 of the metering barrel 1 are a timing spill port 9 and a metering spill port 15. The timing spill port 9 includes a flow control portion 11 that terminates at the surface of the plunger bore 5, as well as a counter bore 13 that has a considerably larger diameter than the flow control portion 11. The metering spill port 15 likewise includes a flow control portion 17, and a counter bore 19 of enlarged diameter.

The metering plunger 7 has a generally cylindrical body 22. At its upper end, the body 22 includes a recess 23 for receiving and coupling to air bias spring (not shown) that provides a bias load to the plunger 7 within the bore 5 during the operation of the surrounding fuel injector (also not shown). The upper end is surrounded by a reduced diameter portion 24 of the cylindrical body 22. A valve edge 25 is defined at the intersection of the reduced diameter portion 24 and the lower portion of the cylindrical body 22. The lower end of the cylindrical body 22 includes an annular groove 26 defined between top and bottom valve edges **27*a*, 27*b*. A diametrical bore 28 extends through the annular groove 26 as shown, and fluidly interconnects the groove 26 with an axial bore 30. During the operation of the fuel injector, the valve edges 25, 27*a*, and 27*b* interact with the intersections or interfaces between the flow control portions 11, 17 of the timing and metering spill ports 9, 15 and the surface of the plunger bore 5. Specifically, as the metering plunger 7** reciprocates within the plunger bore 5, the valve edges 25, 27*a*, and 27*b* interact with the timing and metering spill port interfaces 32*a*, 32*b* to regulate a flow of pressurized diesel fuel in spool-valve fashion. Hence, if pressurized diesel fuel was admitted into both the timing spill port 9 and the metering spill port 15 while the metering plunger 7 was in the position illustrated in FIG. 1A, no oil would flow through the flow control portion 11 of the timing spill port 9, as valve edge 25 is even with the upper edge of the port portion 11. However, some fuel would be allowed to flow from the port portion 17 of the metering spill port 15 into the annular groove 26 (and from thence through the axial bore 30 via diametrical bore 28) as the lower valve edge 27*b* of the groove 26 is below the upper edge of the port portion 17 of the metering spill port 15.

The ability of the metering barrel 1 to precisely regulate a flow of fuel through its respective fuel injector is directly dependent upon the maintenance of a precise relationship between the length of the stroke of the reciprocating metering plunger 7, and the axial dimensions of the timing and metering spill ports 9, 15 at their respective interfaces 32*a,b* with the plunger bore 5. Consequently, anything that alters the dimensions of these ports at the interfaces 32*a,b* along the axis of the barrel 1 will result in a mistimed flow of either too much or too little fuel from the injector to its respective cylinder in the diesel engine (not shown). Unfortunately, during the manufacture of the injector metering barrel, diameter-altering microburrs 34 are produced at the interfaces 32*a,b* of the timing and metering spill ports 9, 15 and the plunger bore 5 in at least two ways. First, relatively large microburrs 36 are formed as a result of the honing operations necessary to smooth and polish the surface of the plunger bore 5 to the extent necessary to create a dynamic fluid seal between the bore 5 and the outer surface of metering plunger 7. Secondly, smaller microburrs 38 are formed from the laser boring operations that create the flow control portions 11 and 17 of the timing and metering spill ports 9 and 15. While the laser boring microburrs 38 are significantly smaller than the honing operation microburrs 36, they are still sufficiently large to interfere with the metering function of the barrel 1. Hence it would be desirable if both types of microburrs 36, 38 were smoothly and precisely eliminated from the interfaces 32*a,b*.

Figure 2A:
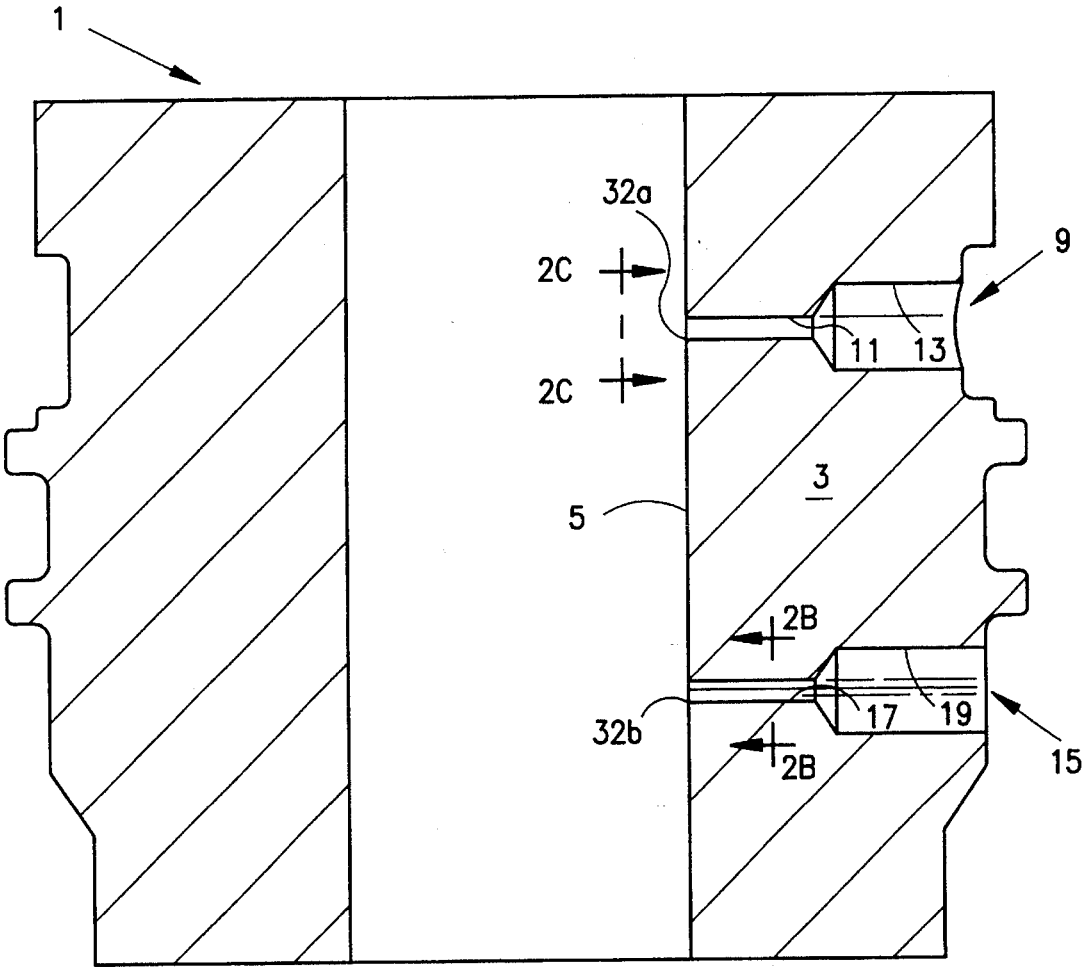
FIG. 2A PRIOR ART
FIG. 2A is a cross-sectional side view of an injector metering barrel whose timing spill port has been deburred under a prior art method, but whose metering spill port has not yet been deburred.
Figure 2B:
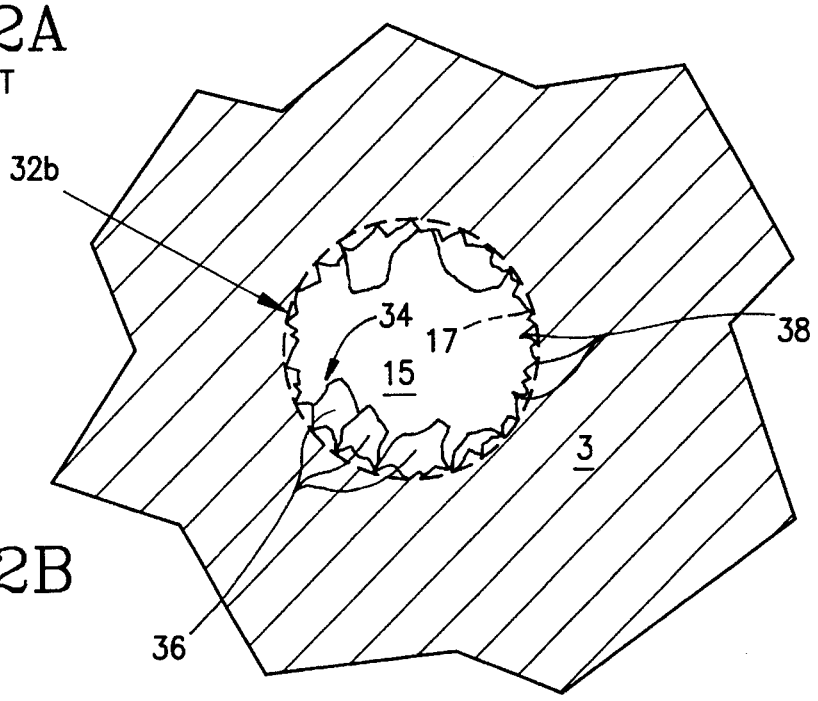
FIG. 2B is an enlarged cross-sectional back view of the flow control portion of the metering spill port along the line 2B—2B in FIG. 2A, illustrating the microburrs that must be removed from the bore.
Figure 2D:
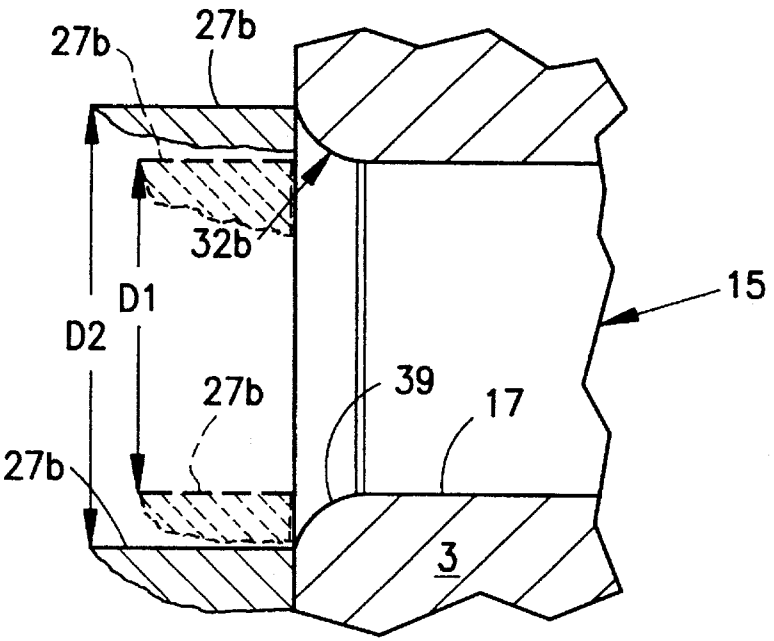
FIG. 2D PRIOR ART
FIG. 2D is a side view of the interface between the timing spill port and plunger bore illustrated in FIG. 2C, illustrating in particular how the radiusing at this interface results in a valving action with the metering plunger that begins earlier and ends later than was originally intended.
Figure 2C:
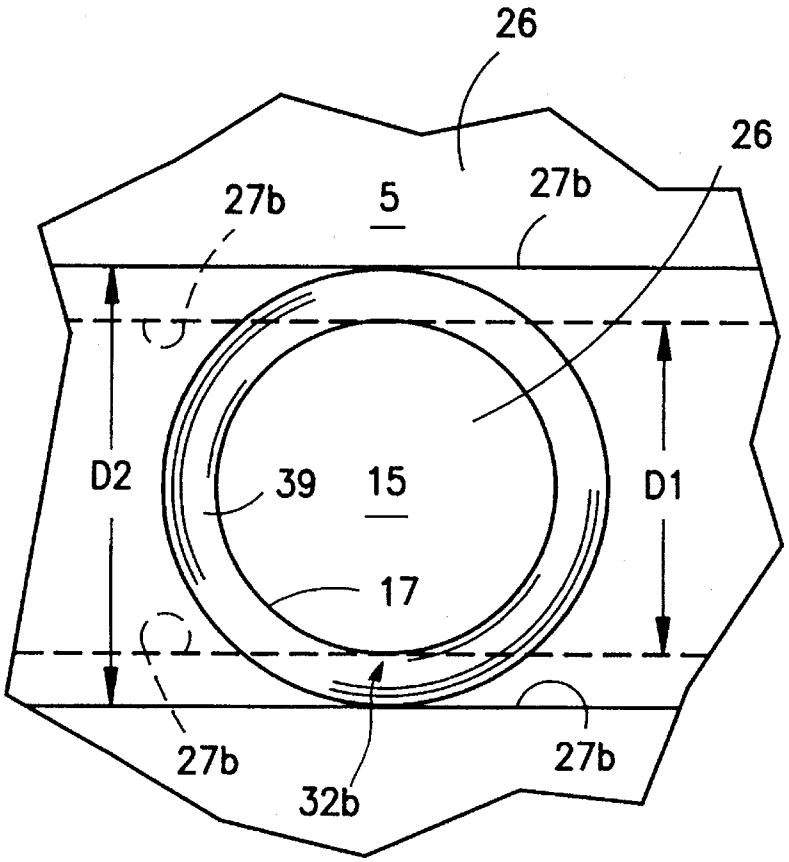
FIG. 2C PRIOR ART
FIG. 2C is an enlarged front view of the flow control portion of the timing spill port along the line 2C—2C in FIG. 2A, illustrating how the prior art method has resulted in radiusing of the port at the interface with the plunger bore.

FIGS. 2C and 2D illustrate the result of prior art deburring methods wherein a pressurized abrasive liquid is forced through the flow control portions 11, 17 of the timing and metering spill ports 9 and 15. Such prior art methods result in the creation of a radiused, trumpet-shaped area 39 in the interface bores 32*a,b* (although only interface 32*b* is shown in the Figures). Such radiusing probably occurs from the high pressures used in such abrasive liquid deburring methods, in combination with the fact that the pressurized liquid interfaces with a gas (i.e., the ambient atmosphere) as it is expelled from the interface area. The combination of these factors is believed to encourage the abrasive liquid to move radially with respect to the center line of the port portions 11 and 17, thereby cutting the interfaces 32*a,b* in roughly a trumpet-shaped pattern. FIGS. 2C and 2D further illustrate how the resulting radiusing seriously interferes with the metering barrels' ability to accurately regulate a flow of fuel. If the flow control portion 17 of the port 15 were microdeburred without radiusing, fuel would be allowed to flow into the groove 26 of the body 22 of the plunger 7 only during the time period that the valve edge 27*b* (shown in phantom) moved an axial distance D1. However, when the interface 32*b* has been radiused in the manner illustrated in FIGS. 2C and 2D, the flow of fuel occurs throughout a substantially larger distance D2 corresponding to the enlarged diameter of the bore portion 17 at the interface 32*b*. As a consequence, fuel begins to flow early and stops flowing later than intended, which causes the injector to conduct an excessive amount of fuel into its respective diesel cylinder.

FIG. 3 illustrates an abrasive gas generating system 40 for implementing the method of the invention. The system 40 includes a nozzle assembly 41 having a nozzle tip 42 insertable within the counter bores 13 and 19 of the timing and metering spill ports 9 and 15. For durability, the nozzle tip 42 is formed from a hard ceramic material, such as tungsten carbide. The nozzle tip 42 includes a gas emitting orifice 43 concentrically disposed along its center line for emitting a laminar jet 44 of an abrasive gas that is columnar in shape. The abrasive particles 45 entrained in the jet 44 smoothly and precisely remove the microburrs 34 present at the interfaces 32*a,b* between the plunger bore 5 and flow control and metering spill ports 11 and 15 of the barrel 1. In the preferred embodiment, the abrasive particles 45 are irregularly-shaped particles of aluminum oxide having an average diameter of 27 microns, although particles having diameters between about 10 and 50 microns would also be effective. The carrier gas used to form the abrasive gas jet is preferably air compressed to between 100 and 150 psi, and most preferably 120 psi.

To supply the nozzle assembly 41 with the materials necessary to form the abrasive jet 44, the system 40 includes a source 46 of compressed air which may be either a compressed air tank as is indicated in the Figure, or the combination of a reservoir tank and an air compressor. The source of compressed air 46 is fluidly connected to a mixing chamber 47 by way of a conduit 48. A gas filter 50, pressure gauge 52, and pressure regulator 54 are serially connected together between the compressed air source 46 and the mixing chamber 47 via the conduit 48 as indicated. The mixing chamber 47 includes a reservoir of the aforementioned abrasive particles 45 which are continuously intermixed with air present in the chamber by means of a vibrator 58. The resulting mixture of abrasive particles and compressed air is conducted to the nozzle assembly 41 by way a connecting hose 60 and coupling 62.

The final component to implement the method of the invention is a tubular shield 64 for preventing the columnar jet of abrasive gas 44 emitted from the interfaces 32*a,b* from impinging on and abrading the micro-finish surface of the plunger bore 5. To this end, the shield 64 includes a tubular wall 65 whose outer diameter is closely dimensioned to the inner diameter of the plunger bore 5. At its upper portion, the shield 64 is provided with an annular stop and alignment flange 66. At its central portion, the shield 64 includes a pair of apertures 68*a,b* which are registrable with, and slightly larger than the diameters of the flow control portions 11 and 17 of the timing and metering spill ports 9 and 15 at the interfaces 32*a,b*.

In the first step of the method of the invention, the tubular abrasion shield 64 is dropped into the plunger bore 5 until the stop and alignment flange 66 rests on the upper surface of the barrel 1. The flange 66 is dimensioned such that the jet conducting apertures 68*a,b* of the shield wall 65 are at the same axial distance down the plunger bore 5 as the bore interfaces 32*a,b* when the flange 66 rests on the top wall of the barrel 1. Alignment is next achieved by merely turning the shield 66 a proper angular distance until the jet conducting apertures 68*a,b* surround the bore interfaces 32*a,b*.

Next, the nozzle tip 42 of the abrasive gas generating system 40 is inserted into the counter bore 13 of the timing spill port 9 until the end of the nozzle tip is between about 4 and 5 nozzle diameters from the microburrs 32*a*. The importance of such alignment and axial distancing is best understood with respect to FIGS. 4A and 4B. When the mixture of abrasive particles 45 and compressed air initially leaves the orifice 43 of the nozzle tip 42, the columnar flow of compressed air immediately increases in velocity due to the pressure differential between the interior of the nozzle tip 42 and the ambient atmosphere. Because of the compressibility of the flowing gas, and the inertia of the abrasive particles 45, the velocity of the abrasive particles 45 does not meet its maximum value until the particles have had an opportunity to "catch up" with the fast moving columnar jet of air that they are entrained within. The inventor has observed that such velocity maximization does not occur until the particles have had an opportunity to move along the axis of the columnar jet 44 between about 4 and 5 orifice diameter lengths X. After that point, the velocity of the abrasive particles 45 actually begins to slow down as a result of the slowing down of the air jet that carries them. In the context of this application, the "focal plane" of the columnar jet 44 of abrasive gas is the plane P that extends orthogonally across the columnar jet 44 where the velocity of the abrasive particles 45 is at its maximum. Such distancing maximizes the microdeburring efficiency of the columnar jet 44.

Still another factor that maximizes microdeburring efficiency is the dimensioning of the internal diameter X of the orifice 43 to be the same or substantially the same as the internal diameter Y of the flow control portions 11, 17 of the ports being microdeburred. If the inner diameter X of the orifice 43 is made to be substantially larger than the inner diameter Y of the flow control portion, fluid turbulence would be generated at the transition region between the counter bore and the flow control portion of the timing or metering spill port 9, 15. Such turbulence would interfere with the microdeburring efficiency of the abrasive jet 44. On the other hand, if the diameter of the orifice X were made to be substantially smaller than the inner diameter Y of the bore portion being microdeburred, the diameter of the columnar jet 44 would be smaller than the diameter of the flow portion in the vicinity of the bore interface 32*a,b*. Such a smaller diameter would require a rotary movement of the nozzle tip 42 if the resulting, small-diametered jet 44 is to microdeburr the entire circumference of the bore at the interface region.

In the preferred embodiment of the method, aluminum oxide particles having a diameter of between about 10 and 50 microns are used. The applicant has found that the crystalline structure of aluminum oxide imparts various angular shapes to the small particles that enhances their cutting action, and facilitates the achievement of a sharp, clean edge at the bore interfaces 32*a,b*. The pressure of the compressed air that acts as a carrier of the aluminum oxide micro particles is preferably between 100 and 150 psi. Finally, the duration of the abrasive jet is preferably between 2 and 5 seconds, and is most preferably 3 seconds. The fact that the columnar jet 44 of abrasive gas requires several seconds to completely perform the microdeburring operation is advantageous in that it is an easy matter for the valves and pumps within the abrasive gas generating system 40 to start and stop the jet 44 within such a time period.

After the microdeburring step has been completed and the nozzle assembly 41 of the abrasive gas generating system 40 has been deactuated, the operator removes the nozzle assembly 41 from the counter bore 13 of the timing spill port 9, and reinserts the nozzle assembly 41 into the counter bore 19 of the metering spill port 15. The aforementioned steps are repeated in order to microdeburr the flow control portion 17 of the metering spill port 15. The nozzle assembly 41 is then completely removed from the metering barrel, as is the tubular abrasion shield 64. The metering barrel 1 is then initially cleaned with compressed air, and given a final cleaning via an ultrasonically agitated liquid in order to remove all abrasive particles 45 which could scar the walls of the metering barrel 1 after it is assembled into a fuel injector.

While this invention has been described with respect to a preferred embodiment, various additions, variations, and modifications will become evident to persons skilled in the art. All such additions, variations, and modifications are intended to be encompassed within the scope of this invention, which is limited only by the claims appended hereto.

What is claimed:

1. A method of microdeburring the interface between a bore and a surface in a workpiece with a nozzle means that selectively directs a columnar jet of abrasive gas, comprising the steps of:

aligning and positioning said nozzle means with respect to said bore so that said jet of abrasive gas is focused on said interface, and actuating said nozzle means for a time period sufficient for said abrasive jet to remove burrs from said interface but insufficient for the jet to cause unwanted radiusing of said bore in the vicinity of said interface, and deactuating and removing said nozzle means from said bore, wherein said bore leads into a finished surface of said workpiece, and further comprising the step of interposing a shield means between said bore and said finished surface odor to actuating said nozzle means to prevent said abrasive jet from abrading said finished surface.

2. The method of microdeburring as defined in claim 1, wherein abrasive gas jet has a focal plane, and nozzle means is aligned and positioned with respect to said bore such that said jet focal plane is substantially adjacent to said interface.

3. The method of microdeburring as defined in claim 2, wherein said nozzle means has an outlet for emitting said jet, and wherein the diameter of said outlet is substantially the same as said adjacent portion of said bore.

4. The method of microdeburring as defined in claim 2, wherein said nozzle means is inserted in said bore.

5. The method of microdeburring as defined in claim 1, wherein said workpiece is a fuel injector metering barrel, and said surface is a plunger bore extending axially through said barrel, and said bore includes a metering spill port and a timing spill port extending completely through a wall of said barrel and interfacing with said plunger bore.

6. The method of microdeburring as defined in claim 5, wherein said abrasive jet is formed from abrasive particles entrained in a gas pressurized between about 100 and 150 psi.

7. The method of microdeburring as defined in claim 6, wherein said abrasive particles have an average length of between about 10 and 50 microns.

8. The method of microdeburring as defined in claim 5, wherein each of said ports includes a smaller diametered and a larger diametered portion, and said small diametered portion interfaces with said plunger bore, and wherein said nozzle is inserted into said larger diametered portion in order to align it with the smaller diametered portion.

9. The method of microdeburring as defined in claim 8, wherein the outer diameter of the nozzle means is only slightly smaller than the inner diameter of the larger diametered portion such that said nozzle means becomes concentrically aligned with said smaller diametered portion when inserted in said larger diametered portion.

10. A method of microdeburring the flow control portions of the timing and metering spill ports of the metering barrel of a fuel injector with a nozzle means that selectively directs a columnar jet of abrasive gas, comprising the steps of:

aligning and positioning the nozzle means with respect to the flow control portion of one of said timing and metering spill ports so that a jet of abrasive gas emitted from the nozzle means is focused at an interface between said flow control portion and a plunger bore that forms the inner diameter of the metering barrel;

actuating the nozzle means for a time period sufficient for the abrasive jet to remove microburrs from the flow control portion of the bore around said interface, but insufficient for the jet to cause unwanted radiusing of the said portion around said interface;

deactuating and removing the nozzle means from said bore;

aligning and positioning said nozzle means with respect to the other of said timing and metering spill ports, so that the jet of abrasive gas is focused on the interface between the flow control portion of the bore and said plunger bore;

actuating said nozzle means for a time period sufficient for said abrasive jet to remove burrs from said interface but insufficient for the jet to cause unwanted radiusing of said bore portion around said interface, and deactuating and removing said nozzle means from said metering barrel.

11. The method of microdeburring a metering barrel as defined in claim 10, wherein the abrasive gas jet has a focal plane, and said nozzle means is aligned in position with respect to said bore such that said jet focal plane is substantially adjacent to said interface between said flow control portions of said timing and metering spill ports in the area of interface with said plunger bore.

12. The method of microdeburring as defined in claim 11, wherein said nozzle means has an end with an orifice that emits said jet, and wherein said orifice end is positioned with respect to said interface between about 4 and 5 diameter lengths of said orifice.

13. The method of microdeburring as defined in claim 10, wherein the tubular abrasion shield is inserted around the surface of said plunger bore of said metering barrel prior to the actuation of said nozzle means in order to protect a polished surface of said plunger bore from unwanted abrasion.

14. The method of microdeburring as defined in claim 2, wherein the abrasive jet is formed from abrasive particles of aluminum oxide entrained in air pressurized between about 100 and 150 psi.

15. The method of microdeburring as defined in claim 14, wherein the average length of said aluminum oxide particles is between about 10 and 50 microns.

16. The method of deburring as defined in claim 14, wherein said nozzle means is actuated for a time period of between 2 and 5 seconds.

17. The method of microdeburring as defined in claim 10, wherein said nozzle means has an end that includes an orifice whose diameter is substantially the same as the diameter of the flow control portion of the bores being microdeburred.

* * * * *